US006462465B1

(12) United States Patent
Israel et al.

(10) Patent No.: US 6,462,465 B1
(45) Date of Patent: Oct. 8, 2002

(54) LPCVD COATED REFLECTOR

(75) Inventors: Rajasingh Israel, Westlake; Carl Gunter, Twinsburg; Ashfaqul Chowdhury, Mayfield Heights, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/525,099

(22) Filed: Mar. 14, 2000

(51) Int. Cl.[7] ..... H01J 64/34

(52) U.S. Cl. ..... 313/25; 313/112; 313/634; 313/113

(58) Field of Search ..... 313/25, 112, 113; 359/359

(56) References Cited

U.S. PATENT DOCUMENTS

| | | | | |
|---|---|---|---|---|
| 4,398,130 A | | 8/1983 | McFadyen et al. | |
| 4,401,912 A | | 8/1983 | Martzloff et al. | |
| 4,598,348 A | | 7/1986 | Richter | |
| 4,757,236 A | | 7/1988 | Dakin et al. | |
| 4,791,333 A | * | 12/1988 | Morris et al. | 313/25 |
| 4,803,404 A | | 2/1989 | Anderson | |
| 4,918,352 A | | 4/1990 | Hess et al. | |
| 5,041,755 A | * | 8/1991 | Pchelin et al. | 313/25 |
| 5,122,706 A | | 6/1992 | Parrott et al. | |
| 5,143,445 A | | 9/1992 | Bateman et al. | |
| 5,587,626 A | | 12/1996 | Parham et al. | |
| 5,646,472 A | * | 7/1997 | Horikoshi | 313/112 |
| 5,676,579 A | | 10/1997 | Parham et al. | |
| 5,723,937 A | | 3/1998 | Whitman et al. | |
| 5,745,291 A | | 4/1998 | Jenkinson | |
| 5,982,078 A | * | 11/1999 | Krisl et al. | 313/112 |

* cited by examiner

*Primary Examiner*—Vip Patel
*Assistant Examiner*—Ken A Berck
(74) *Attorney, Agent, or Firm*—Fay, Sharpe, Fagan, Minnich & McKee, LLP

(57) ABSTRACT

A shroud (26) for a light producing element (46). The shroud having an elongated reflecting portion (20) with a curved cross-section and an elongated light-transmissive portion (24) with a curved cross-section. A cavity in which the light producing element is disposed is formed between the reflecting portion and the light-transmissive portion. A lamp (40) having a shroud (26) according to the invention is also disclosed as is a method of fabricating a shroud according to the invention.

20 Claims, 4 Drawing Sheets

LPCVD COATED REFLECTOR

BACKGROUND OF THE INVENTION

1. Field of the Invention

The present invention generally relates to lamps and, more particularly, to lamps having a shroud or reflector that has been coated in whole or in part using low pressure chemical vapor deposition (LPCVD).

2. Discussion of the Art

There is an ever present demand for lamps to have a high lumen output. Flat reflectors external to an envelope of a lamp are often used to reflect light energy produced by the lamp and direct the light energy in a desired direction. These reflectors typically have a reflective coating, such as aluminum deposited with an evaporation technique. Aluminum coated reflectors have a reflectance on an average of less than 90% (FIG. 6, curve A), and are prone to degradation caused by external elements. Heat generated from the light source, in the form of infrared light, may also degrade the aluminum coating. In addition, the infrared light is often reflected towards the light producing element, a filament for incandescent lamps or an arc tube for arc lamps, which can shorten the life of the light source. Flat reflectors have less efficiency in directing light output than reflectors having a curved surface to focus light in a desired direction.

Optical interference films which comprise alternating layers of two or more materials of different refractive index have been used to coat reflectors and envelopes for lamps. Such coatings are used to selectively reflect and/or transmit light radiation from various portions of the electromagnetic spectrum such as ultraviolet, visible and infrared radiation. One application in which these coatings have been found to be useful is in the fabrication of dichroic mirrors, also referred to as cold mirrors. A cold mirror in the prior art is a glass or plastic reflector coated on the inside reflecting surface with an optical filter which reflects visible light thereby projecting it forward of the reflector, while at the same time permitting longer wavelength infrared energy to pass through the coating and the reflector. This insures that the light projected forward by the reflector is much cooler than it would otherwise be if both the visible and the infrared light were reflected and projected forward. For example, co-owned U.S. Pat. No. 5,143,445 to Bateman et al. discloses an LPCVD coated cold mirror glass reflector having an optical interference film deposited on both sides of parabolic reflector with an elongated rearward cavity portion.

BRIEF SUMMARY OF THE INVENTION

The present invention provides a shroud for a light producing element. The shroud has an elongated reflecting portion having a curved cross-section and an elongated light-transmissive portion having a curved cross-section. A cavity in which the light producing element is disposed is formed between the reflecting portion and the light-transmissive portion.

According to another aspect of the invention, a lamp has a light transmissive envelope and a light producing element disposed within the envelope. The lamp has a shroud disposed in the envelope and disposed around the light producing element. The shroud has an elongated reflecting portion having a curved cross-section and an elongated light-transmissive portion having a curved cross-section.

According to another aspect of the invention, a method of fabricating a shroud for a light producing element includes the steps of providing an elongated reflecting portion having a curved cross-section and providing an elongated light-transmissive portion having a curved cross-section. The method also includes securing the reflecting portion and the light-transmissive portion together, the light producing element disposed in a cavity formed between the reflecting portion and the light-transmissive portion.

DETAILED DESCRIPTION OF THE INVENTION

Figure 1:
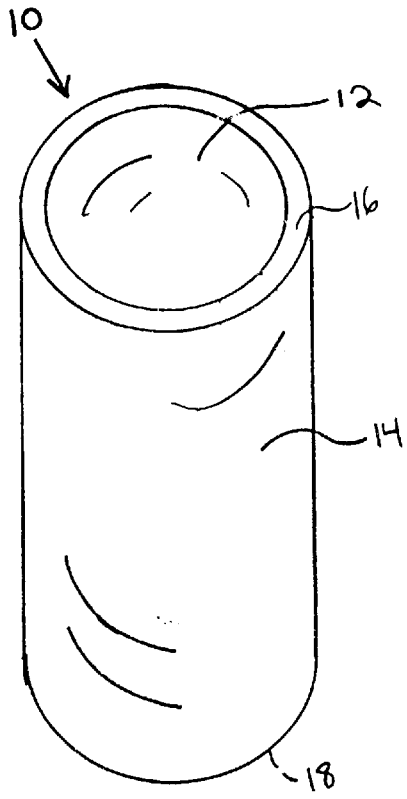
FIG. 1 is a shroud according to the present invention in an intermediate stage of fabrication.
Figure 4:
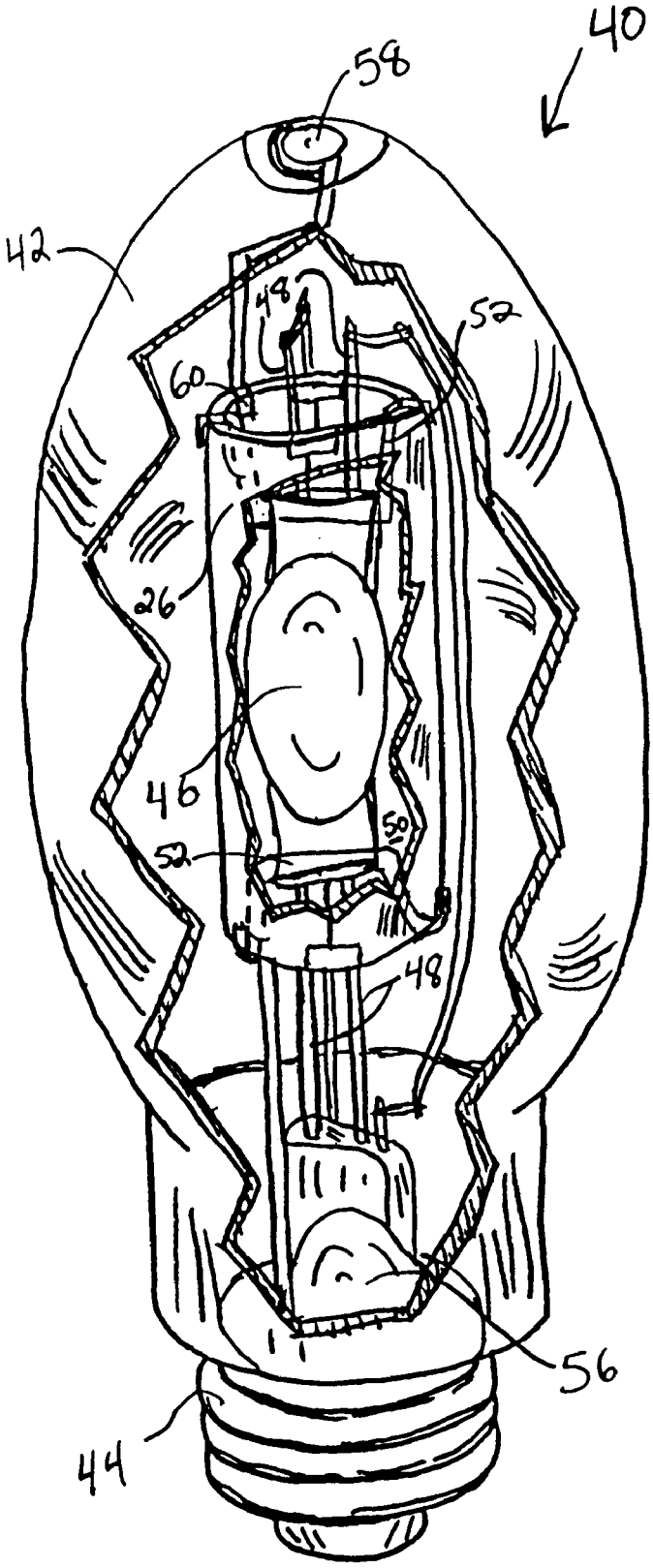
FIG. 4 is a lamp having the shroud according to the present invention.

FIG. 1 schematically illustrates a reflecting member. In the illustrated embodiment, the reflecting member is an all glass or all quartz substrate which has been coated on all surfaces with an optical interference coating, or film, to form a cylinder 10. As will be described in more detail below, the cylinder 10 can be used in the fabrication of a shroud for a light source capsule of a lamp (FIG. 4). The cylinder 10 has an internal surface 12 and an external surface 14. The cylinder 10 also has a first end 16 and a second end 18. In the illustrated embodiment, the cylinder 10 has a hollow circular cross-section having an inside diameter of about 38 to 40 mm, a thickness of about 1.6 mm and a length of about 68 mm.

Figure 6:
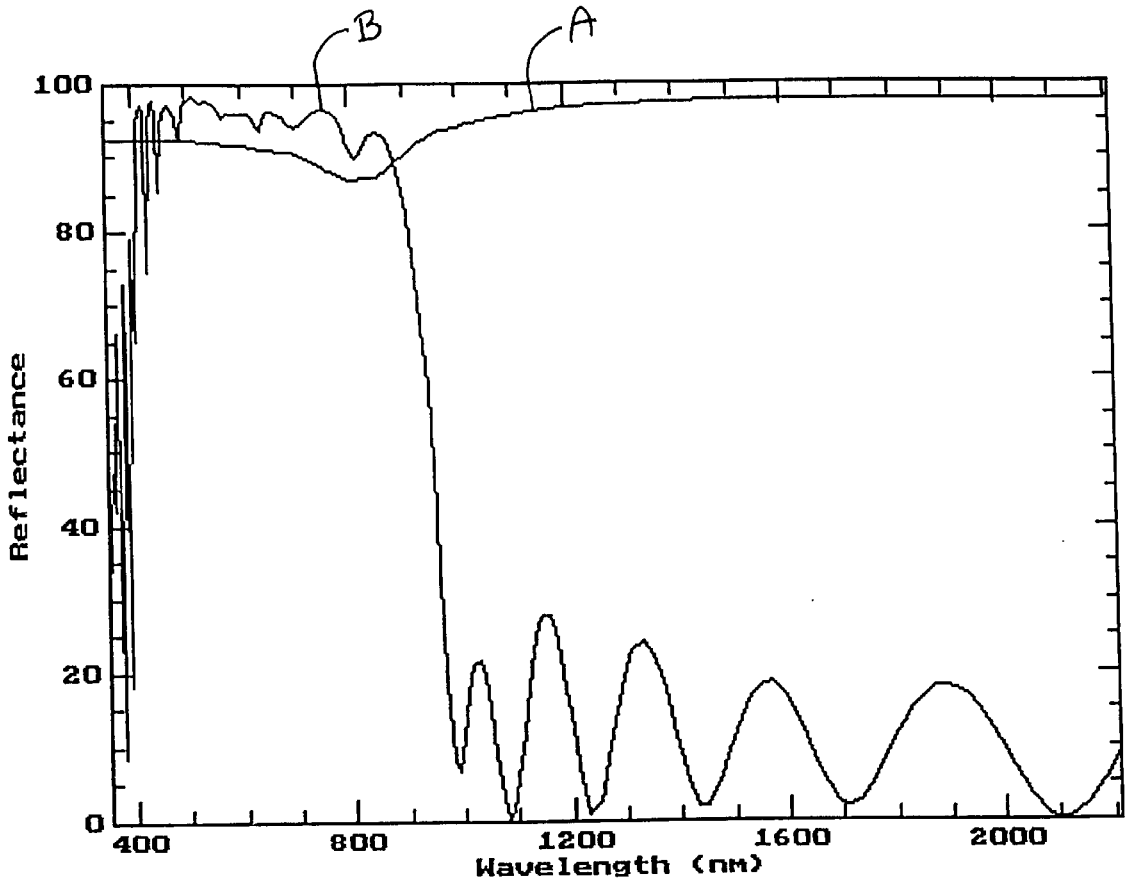
FIG. 6 illustrates the spectral reflectance and transmittance of an optical interference coating applied to a shroud or reflector according to the invention and illustrates the spectral reflectance and transmittance of a convention aluminum coated reflector.

The optical interference coating imparts a dichroic quality to the cylinder 10 such that the cylinder 10 will act as a cold mirror. Referring briefly to FIG. 6, curve B illustrates the spectral reflectance and transmittance of the optical interference coating. As illustrated, the coating reflects light having visible wavelengths (about 400 nm to 800 nm) and is transmissive to infrared light (i.e., light having a wavelength greater than 900 nm). The coating reflects at least 90% of visible light having a wavelength between 400 and 800 nm and transmits at least 80% of infrared radiation having a wavelength greater than 900 nm. An exemplary embodiment suitable for this purpose and methods of applying such a coating to glass or quartz substrates are more fully discussed in co-owned U.S. Pat. No. 5,143,445 to Bateman. The cylinder 10 is coated with an optical interference coating consisting of alternating layers of a silicon compound (e.g., silica, SiO, $SiO_2$, SiC, or $Si_3N_4$) and at least one metal oxide of titanium (e.g., titania, TiO, $TiO_2$, or $Ti_2O_3$), tantalum (e.g., tantala, or $Ta_2O_5$), niobium (e.g., niobia, NbO, $NbO_2$, or $Nb_2O_5$), zirconium (e.g., $ZrO_2$) and vanadium (e.g., $V_2O_3$, $V_2O_4$ or $V_2O_5$), for a total of 26 layers. Alternatively, more than or less than 26 layers may be used. The layers are applied with an LPCVD process as set forth in U.S. Pat. No. 5,143,445. Alternatively, any thin film deposition technique, including, but not limited to, sputtering or electron beam evaporation deposition, may also be used.

All surfaces of the cylinder 10 are coated including the internal surface 12, the external surface 14, the first end 16 and the second end 18. If the cylinder 10 is not coated with the optical interference coating, the cylinder 10 would be light-transmissive to ultraviolet, visible and infrared wavelengths.

Figure 2:
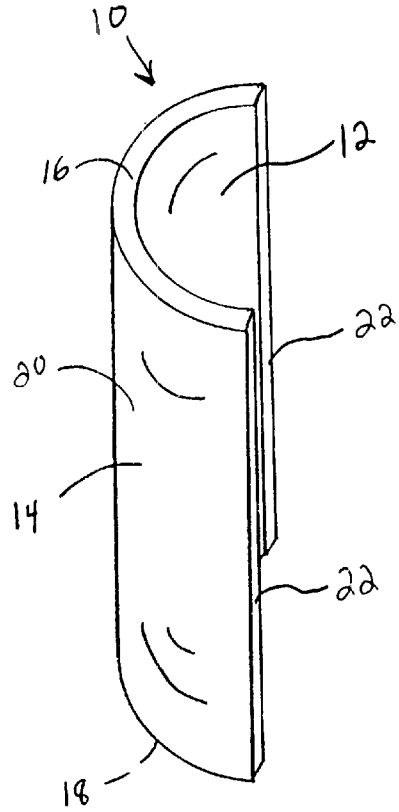
FIG. 2 is the shroud according to the present invention in another intermediate stage of fabrication.

Referring now to FIG. 2, the cylinder 10 is divided into two generally equal portions. For clarity, FIG. 2 illustrates one of the two portions. The cylinder 10 is cut along a longitudinal axis so that the two portions of the cylinder 10 are semi-cylindrical reflecting portions 20. After the cylinder 10 is cut, the resultant reflecting portion 20 will have a pair of longitudinal edges 22 as illustrated. The edges 22 will not be coated with the optical interference coating. In an alternative embodiment, the cylinder 10 can be divided into two semi-cylindrical sections before it is coated and then coated on all of the surfaces, including the longitudinal edges 22. In an alternative embodiment, the cylinder 10 is divided into more than two portions or two unequal portions.

Figure 3:
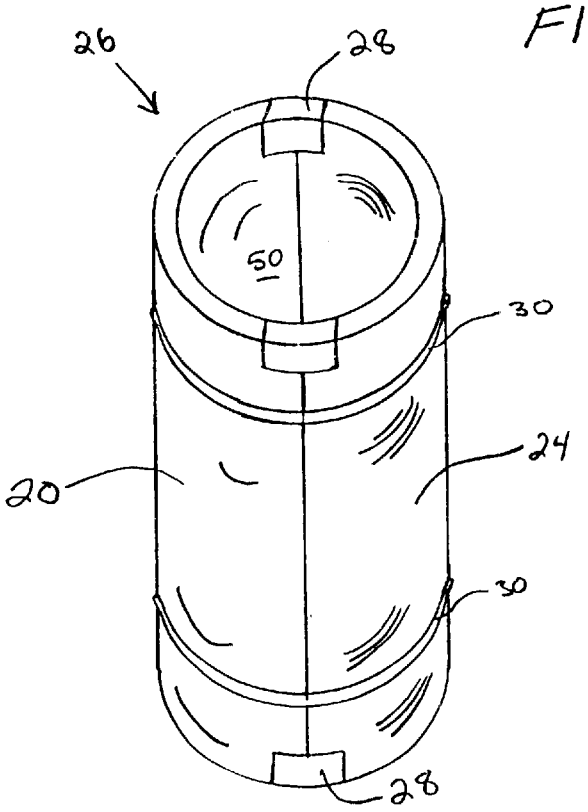
FIG. 3 is the shroud according to the present invention.

Referring now to FIG. 3, the reflecting portion 20 is mated with an uncoated, semi-cylindrical light-transmissive portion 24. The light-transmissive portion 24 is made in similar fashion to the reflecting portion 20. More specifically, a light-transmissive member, such as an uncoated cylinder, is fabricated from glass or quartz and divided into two sections along a longitudinal axis. The longitudinal edges 22 of the respective reflecting portion 20 and the light-transmissive portion 24 are mated against each other so that a fill cylinder is once again formed. The resulting cylinder, or shroud 26, is coated with the optical interference film on one half of the cylinder (the reflecting portion 20) and is transparent to at least visible and infrared light on the other half of the cylinder (the light-transmissive portion 24). The reflective portion 20 and the light-transmissive portion 24 of the shroud 26 are mechanically held together. An example of suitable mechanical fasteners include metal clips 28 disposed over the first end 16 and/or the second end 18 along the seams of the shroud 26 where the longitudinal edges 22 meet. Alternatively, the shroud 26 can be held together with wires 30. The mechanical fasteners (e.g., the clips 28 or the wires 30) should be made out of a material capable of withstanding high heat, such as molybdenum. In an alternative embodiment, the sections 20, 24 of the shroud 26 are fused together obviating the need for mechanical fasteners.

The illustrated embodiment is a shroud 26 having a circular cross-section formed from the elongated reflecting portion 20 having a curved cross-section and the elongated light-transmissive portion 24 having a curved cross-section. The term curved, as used herein, includes surfaces which are smooth, surfaces that are generally smooth but have irregularities and surfaces that are multi-faceted (e.g., made up of a large number of planar segments), but are generally curved. One skilled in the art will appreciate that there is no requirement for the shroud 26 to have circular cross section. For example, the shroud can have an oval, elliptical or parabolic shape. A parabolic shaped shroud 26 can be constructed in much the same way as the illustrated cylindrical shroud 26. For example, an elongated parabolic section of glass or quartz can be coated with the optical interference film as described above and longitudinal edges of the parabolic section can be beveled to mate with longitudinal edges of an uncoated parabolic section to respectively form the reflective portion 20 and the light-transmissive portion 24. In another embodiment, a reflective portion 20 can have a parabolic cross section, or other shape to help direct light as desired, and the light-transmissive portion 24 can have a semi-circular cross section. In another embodiment, a completely uncoated shroud can be fabricated and then portions of the shroud that are to remain uncoated are masked. Then the optical interference film is deposited on the shroud and the mask is removed, resulting in a shroud 26 which has a reflective coating on one portion and no coating on a second portion.

Referring to FIG. 4, a lamp 40 having a shroud 26 according to the present invention is illustrated. The lamp 40 can be an incandescent lamp with a filament or an arc lamp, such as the lamp disclosed in co-owned U.S. Pat. No. 4,918,352 to Hess. The lamp 40 is provided with an envelope 42 made of glass or other light-transmitting material. The lamp 40 has a base 44 which is hermetically sealed to the envelope 42. The base 44 provides a means for mechanically securing the lamp 40 and for providing electrical connection to the lamp 40. The lamp 40 is provided with a light source capsule 46 such as a vitreous envelope hermetically sealed at ends by means of a customary pinch seal or shrink seal and having exterior electrical leads 48.

As mentioned, the lamp 40 is also provided with a shroud 26 according to the present invention. The light source capsule 46 is disposed in a hollow interior portion 50 of the shroud 26. The shroud 26 is used to support and stabilize the light source capsule 46 and minimize damage in the rare event that the capsule 46 fails in a non-passive manner. U.S. Pat. No. 5,122,706 to Parrott is an example of a support and damage mitigating shroud.

Clips 52 are provided to connect the light source capsule 46 to the shroud 26. The clips 52 connect the first end 16 and the second end 18 of the shroud 26 to respective ends of the light source capsule and/or the electrical leads 48 extending from the light source capsule 46 as is known in the art. More specifically, an upper clip 52 attaches to the first end 16 of the shroud 26 and the upper end of the light source capsule. A lower clip 52 attaches to the second end 18 of the shroud 26 and to the lower end of the light source capsule. The lamp 40 is provided with a support rod 54 attached at a lower end to a stem 56 of the lamp 40 and attached at an upper end to a dimple 58 provided on the envelope 42. The support rod supports the shroud 26 and the light source capsule 46. The shroud 26 is connected to the support rod 54 by known mechanical attachments means such as clamps 60, or alternatively, by attachment means provided on the clips 52 such as found in U.S. Pat. No. 5,122,706. In another embodiment, the reflective portion 20 of the shroud 26 and the light-transmissive portion 24 of the shroud 26 are connected together by the clips 52, obviating the needs for separate fasteners, such as clips 28 or wires 30.

It should be appreciated that by placing the light source capsule inside a shroud 26 having a reflective portion 20 and a light-transmitting portion 24, light can be directed from the lamp 40 in a desired direction. This will increase the lumen output in the desired direction. To assist in orienting the lamp 40 so that the light is directed as desired, the base 44 can be the screw-in type as illustrated in FIG. 4 or a plug-in type having prongs accepted by a connector in a lamp fixture. As discussed earlier, the shroud 26 can have a cylindrical shape or other shape, such as a parabolic shape, to help direct the light output as desired.

Figure 5:
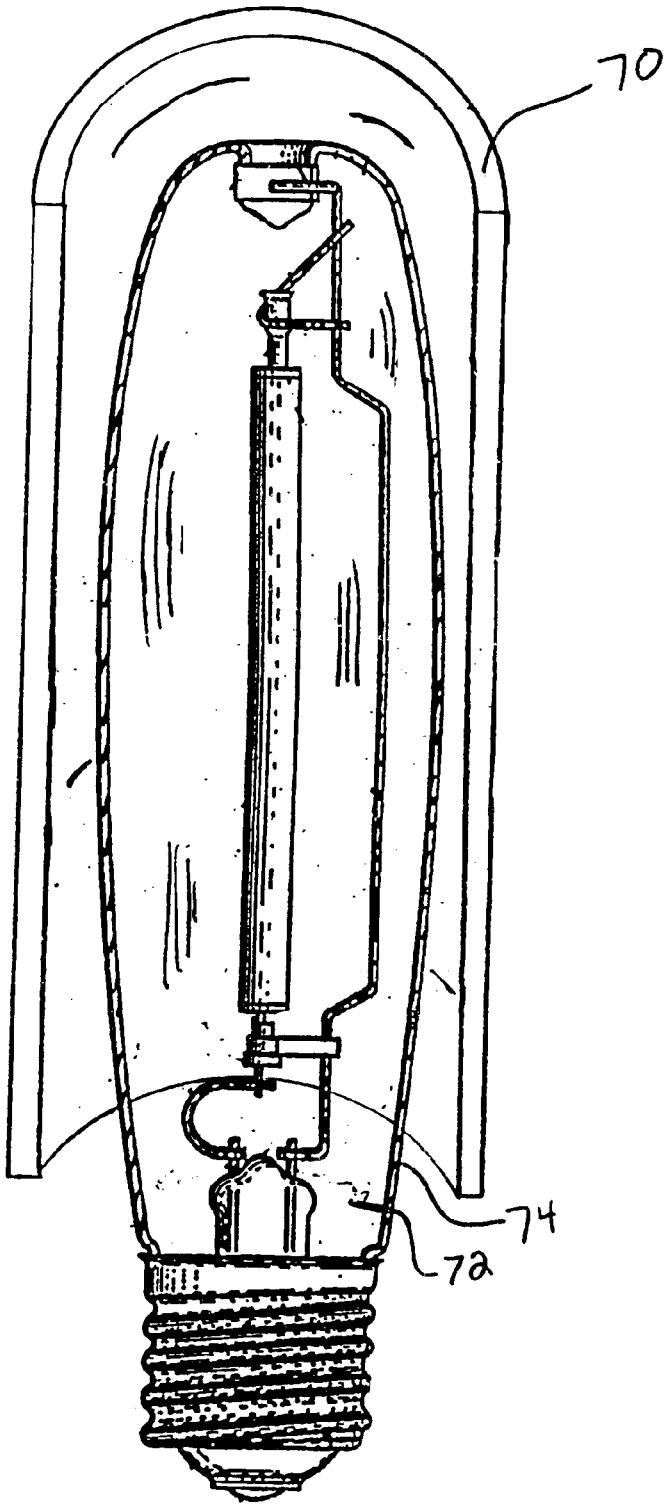
FIG. 5 is a lamp having a reflector according to another aspect of the present invention.

Referring to FIG. 5, a reflector 70, according to the present invention, is illustrated. In the illustrated embodiment, the reflector is positioned adjacent a lamp 72 and is external to an envelope 74 of the lamp. The reflector 70, as illustrated, is semi-cylindrical. However, one skilled in the art will appreciate that the reflector 70 can have any geometrical shape suited to reflect light as desired. The reflector 70 is coated with an optical interference film. The reflector 70 and the lamp 72 are placed in a light fixture housing as is known in the art for residential, industrial and outdoor lighting needs. In an alternative embodiment, the reflector 70 is positioned inside the envelope 74 of the lamp 72. In addition, the reflector 70 can be used in conjunction with lamp 40 having the shroud 26. Alternatively, the envelope 42 or 74 can be partially coated with optical interference film. In this embodiment, the reflector 70 or the shroud 26 having a reflective portion 20 is optional.

A lamp or a lamp fixture having the shroud 26 and/or reflector 70 of the present invention provides a higher light output in a desired direction than a lamp or fixture having a conventional aluminum coated reflector or a flat reflector. In addition, providing a shroud 26 which is partially reflective and partially transparent minimizes or eliminates the need for a separate reflector. Providing a circular shroud 26 which is half reflective and half light-transmissive with a light source capsule 46 disposed in the shroud 26 allows light to propagate in a 180 degree arc from the light-transmissive portion 24 of the shroud 26. The propagating light is made up of light which is reflected off of the reflecting portion 20 of the shroud 26 and light which passes directly through the light-transmissive portion 24 of the shroud 26.

Although particular embodiments of the invention have been described in detail, it is understood that the invention is not limited correspondingly in scope, but includes all changes, modifications and equivalents coming within the spirit and terms of the claims appended hereto.

What is claimed is:

1. A shroud for a light producing element, which minimizes damage in the event of a non-passive failure of the light producing element, the shroud comprising:

an elongated reflecting portion having a curved cross-section; and an elongated light-transmissive portion having a curved cross-section, the reflecting portion and the light-transmissive portion being separately formed and mechanically held together or fused together to form a generally cylindrical body having first and second open ends, a cavity in which the light producing element is disposed being between the reflecting portion and the light-transmissive portion, such that light emitted from the light producing element in a first direction strikes the reflecting portion without first striking the light-transmissive portion and light emitted from the light producing element in a second direction strikes the light-transmissive portion without first striking the reflecting portion.

2. A shroud for a light producing element, which minimizes damage in the event of a non-passive failure of the light producing element, the shroud comprising:

an elongated reflecting portion having a curved cross-section, which defines a first portion of a curve; and an elongated light-transmissive portion having a curved cross-section, which defines a second portion of a curve arcuately spaced from the first portion of the curve, a cavity in which the light producing element is disposed being formed between the reflecting portion and the light-transmissive portion, the reflecting portion being a light-transmissive substrate coated with a dichroic optical interference film.

3. The shroud according to claim 2, wherein the film reflects at least 90% of visible light having a wavelength between 400 and 800 nm, and transmits at least 80% of infrared light having a wavelength of greater than 900 nm.

4. The shroud according to claim 2, wherein the film comprises alternating layers of a silicon compound and at least one metal oxide.

5. The shroud according to claim 1, wherein the film consists of 26 layers.

6. The shroud according to claim 1, wherein the shroud is cylindrical.

7. The shroud according to claim 6, wherein the reflective portion and the light-transmissive portion are semi-cylindrical.

8. The shroud according to claim 1, wherein the reflective portion and the light-transmissive portions are mechanically held together.

9. The shroud according to claim 1, wherein the reflective portion and the light-transmissive portions are fused together.

10. The shroud according to claim 1, wherein the reflective portion has a parabolic cross section.

11. A method of fabricating a shroud for a light producing element, comprising the steps of:

providing an elongated reflecting portion having a curved cross-section;

providing an elongated light-transmissive portion having a curved cross-section; and securing the reflecting portion and the light-transmissive portion together to form a generally cylindrical body having a cross section which includes a first curved portion which is defined by the reflecting portion and a second curved portion arcuately spaced from the first curved portion which is defined by the transmitting portion but not by the reflecting portion, the light producing element disposed in a cavity formed between the reflecting portion and the light-transmissive portion.

12. A method of fabricating a shroud for a light producing element, comprising the steps of:

a) dividing a reflecting member along a longitudinal axis to form an elongated reflecting portion having a curved cross-section;

b) providing an elongated light-transmissive portion having a curved cross-section; and c) after steps a) and b), securing the reflecting portion and the light-transmissive portion together to define a cavity for receiving the light producing element.

13. The method according to claim 12, further comprising the step of coating the reflecting member with an optical interference film before the reflecting member is divided.

14. The method according to claim 12, further comprising the step of coating the reflecting portion with an optical interference film after the reflecting member is divided.

15. The method according to claim 11, further comprising the step of dividing a light-transmissive member along a longitudinal axis to form the light-transmissive portion.

16. A method of projecting light, comprising the steps of:

emitting light from a light source;

reflecting the light in a desired direction using an elongated reflecting element having a curved cross-section; and transmitting the reflected light through an elongated light-transmissive element having a curved surface, the elongated reflective element and elongated light-transmissive elements being separately formed and then secured together to form a generally cylindrical body having a first portion which is defined by the reflecting portion and a second portion which is defined by the light-transmitting portion and is arcuately spaced from the reflecting portion.

17. The method according to claim 16, wherein the reflecting element and the light-transmissive element are connected to form a shroud, the light source disposed in a cavity formed between the reflecting element and the light-transmissive element.

18. The method according to claim 16, wherein the reflecting element is coated with an optical interference film.

19. The shroud according to claim 1, wherein the cylindrical body has a thickness of about 1.6 mm.

20. A lamp comprising:

a light producing element;

a shroud which minimizes damage in the event of a non-passive failure of the light producing element, the shroud having an open end and being formed from:

a elongated reflecting portion having a curved cross section and first and second longitudinal edges ; and a separately formed, elongated light-transmissive portion having a curved cross section and first and second longitudinal edges, the reflecting portion and the light-transmissive portion being mechanically held together or fused together along one of the first and second longitudinal edges of the elongated reflecting portion and one of the first and second longitudinal edges of the elongated light-transmissive portion, a cavity in which the light producing element is disposed being formed between the reflecting portion and the light-transmissive portion.

* * * * *